United States Patent [19]

Fowler

[11] 3,963,854

[45] June 15, 1976

[54] SHIELDED CABLES

[75] Inventor: Eliot Patrick Fowler, Studland, England

[73] Assignee: United Kingdom Atomic Energy Authority, London, England

[22] Filed: Dec. 5, 1974

[21] Appl. No.: 529,721

[52] U.S. Cl. ..... 174/36; 174/106 R; 174/107

[51] Int. Cl.[2] ..... H01B 9/02

[58] Field of Search ..... 174/106 R, 106 D, 108, 174/109, 107, 36, 102 R

[56] References Cited

UNITED STATES PATENTS

| | | | |
|---|---|---|---|
| 1,755,930 | 4/1930 | Middleton | 174/109 X |
| 2,028,793 | 1/1936 | Mascuch | 174/109 X |
| 2,379,318 | 6/1945 | Safford | 174/109 X |
| 2,527,172 | 10/1950 | Beaver et al. | 174/106 R |
| 3,215,768 | 11/1965 | Murphy | 174/106 R |
| 3,636,234 | 1/1972 | Wakefield | 174/109 X |
| 3,643,007 | 2/1972 | Roberts et al. | 174/106 R |

FOREIGN PATENTS OR APPLICATIONS

| | | | |
|---|---|---|---|
| 58,806 | 6/1941 | Denmark | 174/106 |

*Primary Examiner*—Arthur T. Grimley
*Attorney, Agent, or Firm*—Larson, Taylor & Hinds

[57] ABSTRACT

A shielded electrical cable is described having improved interference immunity and radio frequency screening by virtue of the mode of application of the shield. The shield is insulated from the inner conductor or conductors and comprises a pair of coaxial wire braid layers separated by a continuous metal tube which is flexible and does not bind upon the underlying braid. The tube is peferably formed from mu-metal or other metal tape wound onto the braid in partially overlapping helical turns, the winding tension is insufficient for the overlapping margin to compress the underlying margin of the previous turn, this latter operation being performed in a rotary tubular die whose bore allows for a small annular clearance to be preserved between the wound tape tube and the underlying wire braid.

10 Claims, 7 Drawing Figures

TRANSFER IMPEDANCE (ZTm Ω/m AT 100KHz)
1
0.1
0
B
A
NO FLEXING
NO FLEXING
1
2
3
4
5
6
7
8
9
10
100
NUMBER OF TIMES WOUND ONTO A MANDREL 50 m.m. DIAMETER AND OFF AGAIN.

SHIELDED CABLES

BACKGROUND OF THE INVENTION

This invention relates to shielded co-axial and other electrical cables and to methods of making these cables by which interference immunity may be increased. As is well known, a co-axial cable with two or more braided wire screens as the outer conductor over the dielectric has better performance in this respect than a cable having only one braided wire screen. Moreover, it has been shown in the Paper No B11-3 entitled "On the interference immunity of co-axial cables" and read at the EUROCON 71 Conference IEEE Region 8, that the interposition of a layer of magnetic material between these braids makes a very marked improvement in the interference immunity by improved radio frequency shielding. The magnitude of the improvement in interference immunity is a function of the permeability and thickness of the magnetic material used and of the thickness of the effective air gap in the magnetic path presented by the magnetic material.

It is of course important that the addition of magnetic material does not seriously impair the flexibility of the cable inherent in its construction and hence it has been the practice to employ magnetic material in the form of a layer of tape of high permeability such as "mu-metal." It has been found that the way the tape layer is applied can have a large influence on the mechanical and electrical properties of the finished cable.

For example, if the magnetic tape is wound on with the edges of the tape butting between the turns (so as to minimise the air gap) any bending of the cable tends to induce a buckle in the tape with a consequential degradation of both its mechanical and magnetic properties. This drawback may be avoided if the tape is wound on with a gap between successive turns and although this method introduces a larger air gap than with a butted winding, a second layer of tape may be applied in staggered relation to the first. A further alternative, and one with which the invention is directly concerned, is to wind on the tape with a significant overlap, so minimising the air gap. Under these conditions the trailing edge of the tape must stretch an amount proportional to the tape thickness to allow a continuous winding operation without any buildup of diameter. Difficulties arise in applying a tape in this way for if an annealed tape is wound on with a high tension so that it is stretched beyond its elastic limit both edges of the tape will stretch unless very careful control of tension is exercised. The trailing edge of the tape being applied to the cable must wind on to a cable whose radius is increased by the thickness of the immediately preceding lap of tape, hence the trailing edge will stretch a little more than the leading edge. Unfortunately this stretching degrades the magnetic properties and the resulting tight binding effect results in a somewhat stiff cable.

SUMMARY OF THE INVENTION

According to the present invention a shielded cable has a shield which includes a wire braid and a continuous, lengthwise flexible, metal tube enclosing the braid without exerting any radial pressure on the underlying wire braid. The absence of radial pressure is preferable manifest by the presence of a small annular clearance between the metal tube and the underlying braid. Preferably the metal tube is formed by winding a metal tape in a series of overlapping helical turns onto the inside of a rotary tubular die.

The die may contain, at the time of winding the cable internals, eg at least one conductor covered with insulent and one or more wire braids. Alternatively there may be no conducting part of the screen within the die during this winding process. If desired, the tube, formed from overlapping helical tape turns, may be formed in the die and the cable internals inserted afterwards. In any event, the tape "tube" will build up in diameter at the overlap until it meets the inside face of the tubular die and can then get no bigger. The die along with the tape supply is rotated and effects a swaging action which results in the trailing edge of the tape compressing inwards the leading edge of the previous turn of tape. This is achieved without significant stretch of the trailing edge of the tape being applied. Thus there is provided a shielded cable comprising at least one inner conductor electrically insulated from a surrounding wire braid and a metal tape layer wound into a tube overlying the wire braid in such a way that each turn of the tape layer overlaps the immediately previous turn by a substantial amount but without exerting any binding pressure on the wire braid whereby the magnetic properties of the tape are not degraded.

The completed cable comprises an inner conductor or conductors, electrically insulated from the outer shield and generally covered with a protective jacket; the outer shield being preferably made up of a first conducting braided wire screen, a magnetic layer made up of a single helix of a magnetic tape, or the like, and a second conducting braided wire screen portion, the single helix of tape exerting no binding pressure on the underlying first braided wire screen portion. Additional magnetic layers and braided wire screens may also be incorporated. The magnetic tape layer in each case is preferably applied with a continuous overlap and with an inside diameter larger than the immediately underlying braided wire screen. It is not in fact air-insulated from the first braided wire screen and will be found to make contact with this screen at frequent intervals along its length notwithstanding the clearance allowed for during fabrication.

Additional to the avoidance of stretching of the tape during winding is the need to take care that the tape layer is not unduly stressed by the mode of application of any superimposed layers of braid or protective covering which could negate the effect of careful tape application. Flexibility is also of some importance with the facility for bending the shielded cable over a small radius without degrading the magnetic properties of the screen. It is desirable to maintain, in the case of tape-wound screens to maintain a feed angle of tape between 50° and 85° and preferably between 60° and 80°.

The mode of applying a helically wound tape layer described herein is such that the underlapping margin of the tape turn is radially depressed by the inside of the die rather than the tape tension exerting a binding pressure against the underlying wire braid and the clearance under the tape layer allows good flexure without stressing the layer.

The invention extends to include the method of manufacturing a shielded cable of both increased interference immunity and of reduced electromagnetic radiation properties. The method resides in applying at least one magnetic tape layer between two conducting wire braide covering the inner conductor, the method residing in applying a first magnetic tape layer over a first conducting wire braid by leading a magnetic metal tape through an axial slot of finite length in a rotating tubular die through the bore of which die the cable is advanced axially, allowing the tape to wind over the cable as a plurality of partially overlapping helical turns with the overlapping edge of the tape only lightly stretched and maintaining the wound tape at a substantially uniform diameter by its passage through a die portion leading from the axial slot.

In order to effect the winding of the tape into a layer as aforesaid a special winding head/die combination is preferred. In the main this combination comprises a tubular body, having an end portion for engaging a rotary head and a free end portion. Between these two portions a tape supply and tape guide means are mounted to feed tape into a slot of finite axial length in the free end portion. The slot is segmental and cut with one face tangential to the tube bore, the other face is radial and lies in a plane which intercepts the tangential face at the tubular die bore. This allows the tape to enter the slot along the tangential face and wrap round the die bore. The bore size of the tubular die is determined by measuring the outside diameter of the uncompleted cable which the tape is intended to screen and adding to this dimension four times the tape thickness plus a few tenths of a millimeter as clearance (between the tape and the underlying braid). This clearance may be in the range 0.1 mm and 0.4 mm; typically 0.2 mm may be chosen.

The invention includes a die for the application of a screen to a co-axial cable comprising a tubular body whose bore is substantially the diameter of the screened cable, an elongated segmental slot in the tubular body, the slot having a leading face substantially tangential to the bore of the die and a trailing face substantially radial to the bore of the die, the tangential face and the radial face being leading and trailing faces with respect to the direction of rotation of the die and including carrier means, rotatable with the die, for carrying a supply of screening tape and for guiding it into the bore of the die along a plane substantially parallel to the tangential face, or making a small angle with the tangential face.

DESCRIPTION OF THE DRAWINGS

In order that the invention may be better understood the following drawings will be referred to in the description of the preferred constructions and methods

DESCRIPTION OF THE PREFERRED EMBODIMENT

Figure 1:
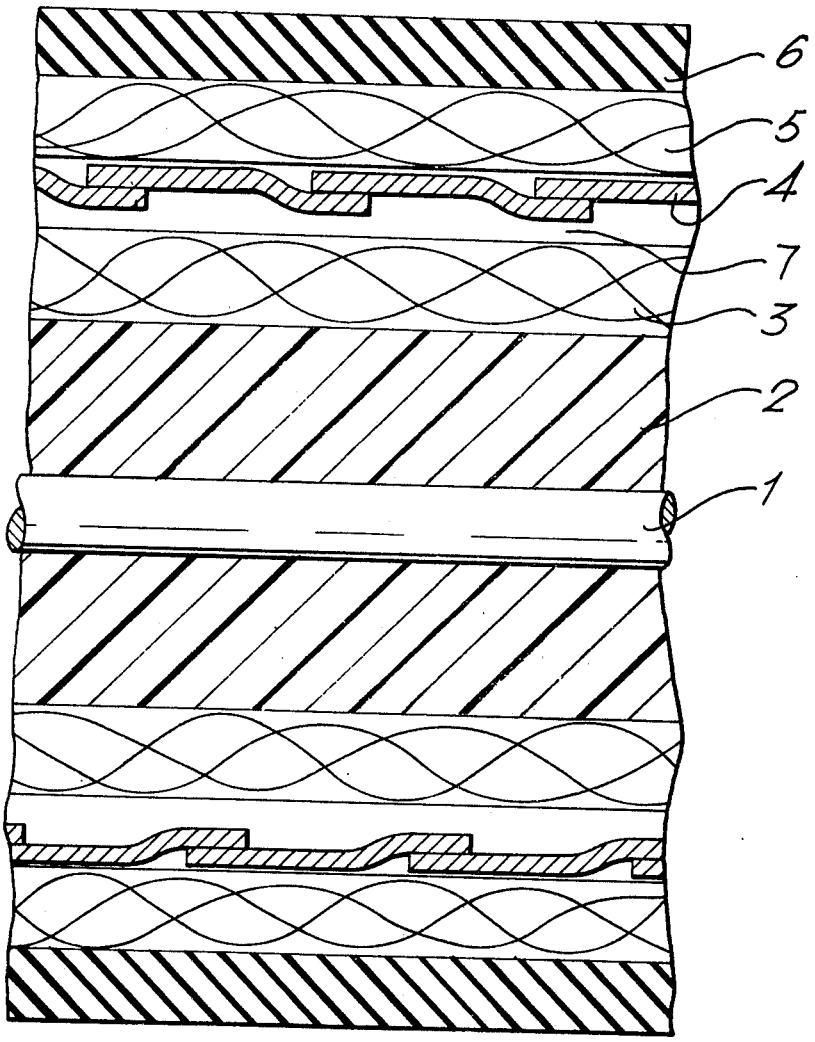
FIG. 1 is an axial cross-section through a length of cable embodying the invention, the cable in this example being a co-axial cable.

Reference to FIG. 1 shows that in this form the invented cable comprises an inner conductor 1 covered with a layer of insulation 2 of plastics material and having a shield which includes a co-axial layer of wire braid 3 and a layer 4 composed of overlapping helical turns of electrically conducting metal tape with an underlying clearance 7.

The wound tape layer 4 forms in effect a length wise flexible metal tube and when wound around the uncompleted cable is wound without exerting any significant binding pressure on the underlying wire braid.

Figure 2:
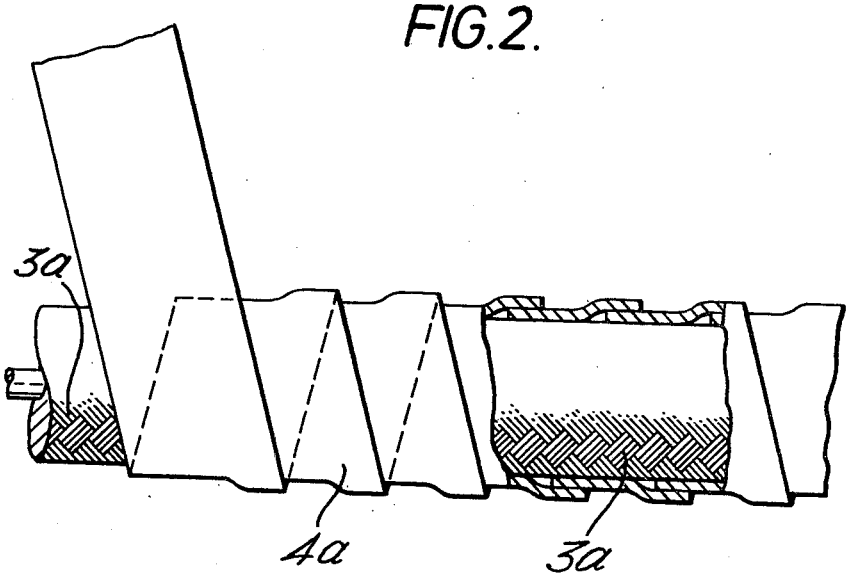
FIG. 2 illustrates a prior art method of applying a wound tape screen
Figure 3:
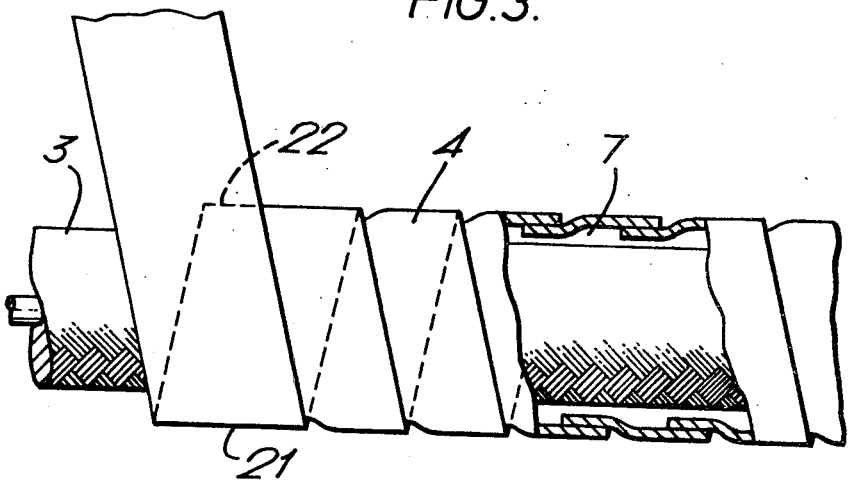
FIG. 3 illustrates an invented mode comparable to FIG. 2 of applying a wound tape screen

The effect of this new mode of application in producing a novel cable may be quickly appreciated from an inspection of FIGS. 2 and 3. FIG. 2 illustrates how in the prior methods of application a tape layer 4*a* undergoes stretching to a marked degree along its leading edge as each turn exerts a strong binding pressure on the underlying braid 3*a* and very close contact between the tape layer 4a and the braid results. In contrast, FIG. 3 shows that the invented cable the tape layer 4 is applied without significant stretching, without exerting a binding pressure on the underlying braid 3 leaving a clearance 7 between the tape layer 4 and braid 3. Clearance 7 is exaggerated in the drawing and results from the absence of binding pressure. This leads to an alternative constructional sequence of the invention wherein the layer 4 is formed as a length-wise flexible tube without any conducting part of the screen inside it.

Means other than tape winding may then be employed to form such a tube. In this description the mode of FIG. 3 will be dealt with in detail by way of non-limitive example; the layer 4 thus constitutes one form of a longitudinally flexible electrically conducting metal tube. The shield further includes a second screen 5 which is also of wire braid applied to the tape layer 4. The screen 5 is encased with an outer non-conductive cover 6. In this cable, designed for high frequencies, the inner conductor forms a first conductor and the braids and tape wound layer 4 a second conductor. The layer 4 is applied to the cable after the insulation 2 and the inner wire braid 3 have been applied to the inner conductor 1.

Figure 4:
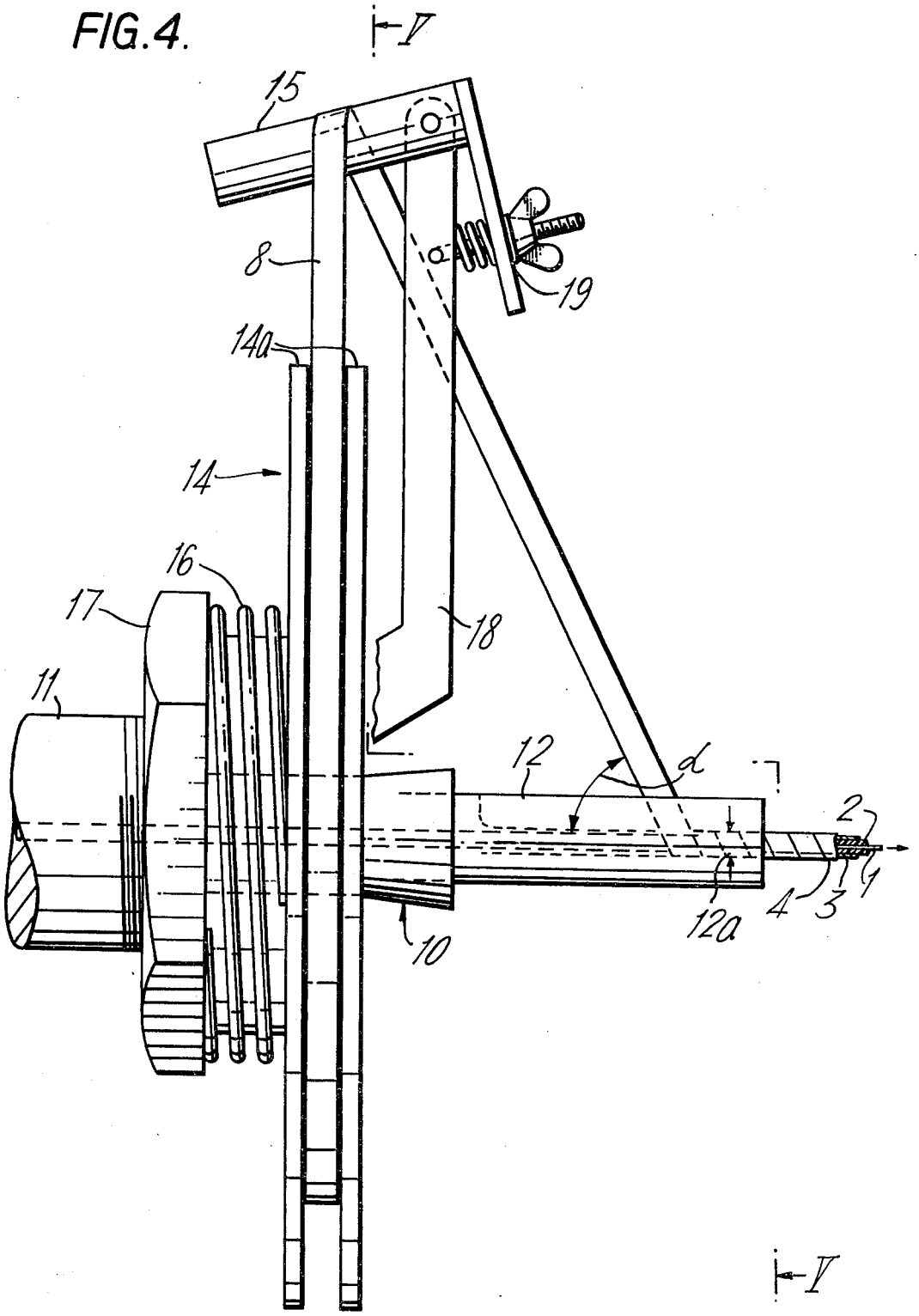
FIGS. 4 and 5 are side and end views respectively of winding apparatus for application of a wound tape screen to the cable
Figure 5:
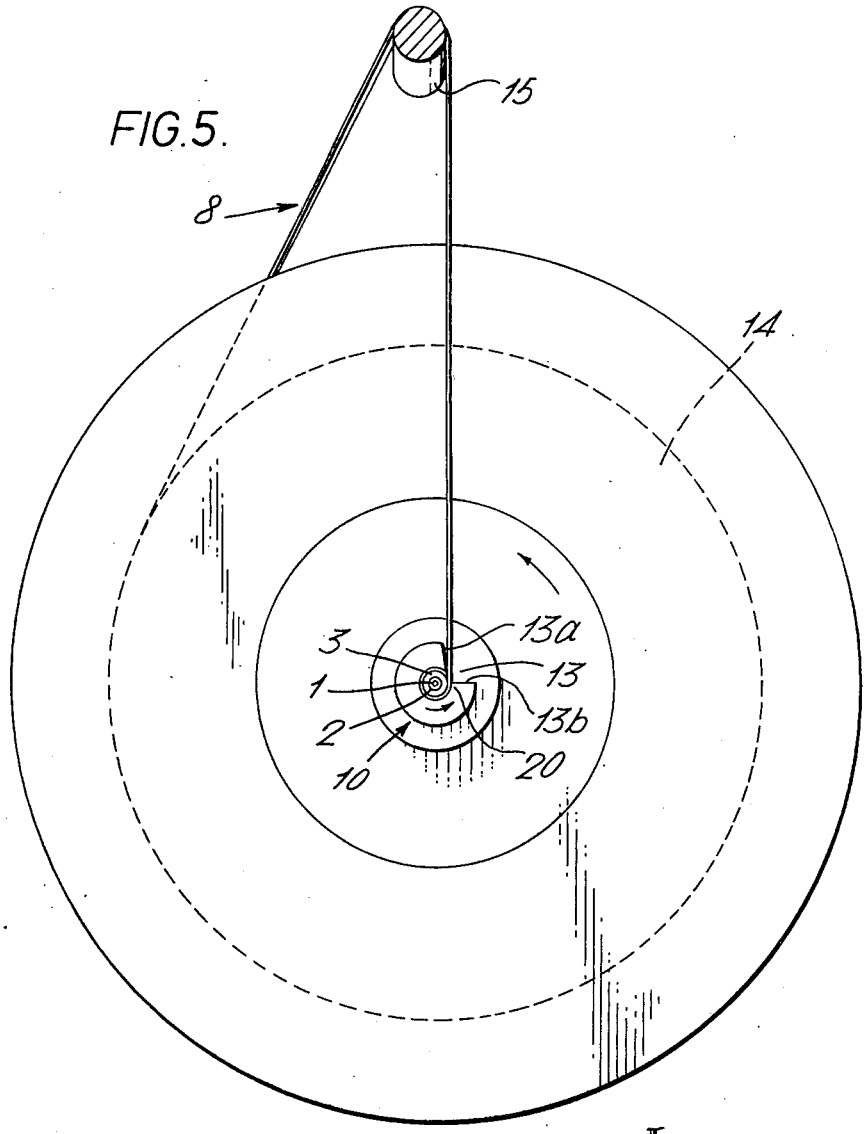
Figure 5A:
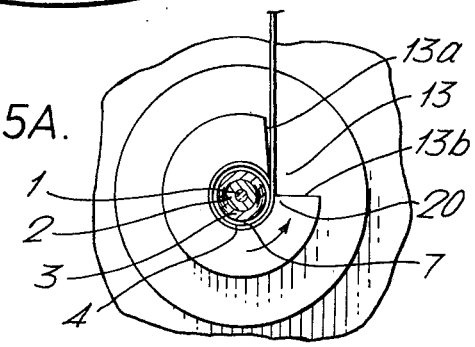
FIG. 5*a* is an enlarged diagram die view of a part of FIG. 4 as viewed in the direction of the arrow A and FIG. 6 is a graph showing the change in transfer impedance when comparative cables are subjected to repeated flexure.
Figure 6:
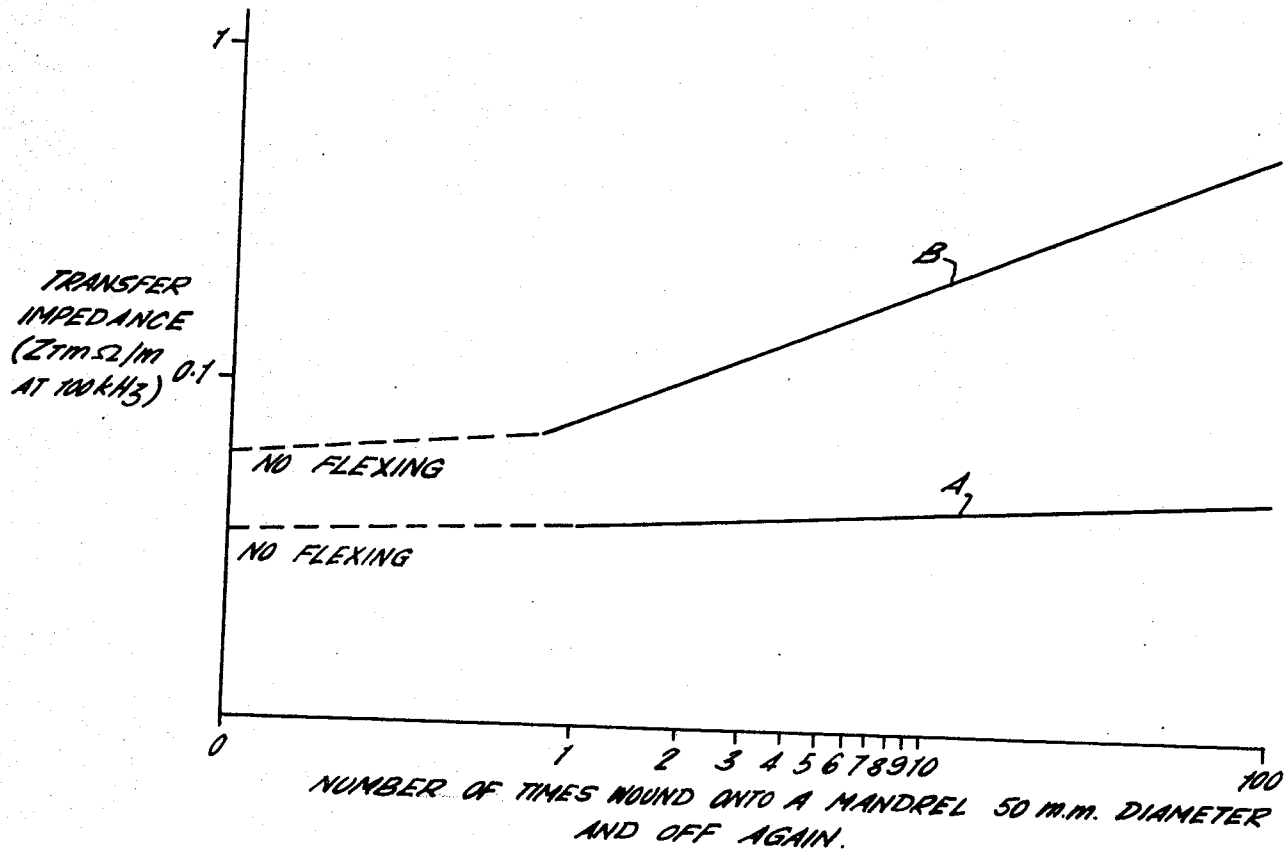

As shown in FIGS. 4 and 5 the cable is fed axially through the bore of a tubular rotary die 10. The die 10 has a rearwardly extending shank 11 adapted to enter a chuck by rotation of which the whole die may be rotated relative to the cable. The forward extending portion 12 of the die has a bore 12a diameter equal to the desired diameter of the applied screen with clearance 7. The portion 12 has one quadrant cut away to form a segmental slot 13 of finite axial length. The slot has a leading face 13*a* lying in a plane tangential to the bore 12*a* and a trailing face 13b lying in radial plane which intersects the tangential plane as foresaid. The terms "leading and trailing edges" are related to the rotational direction of the die, and the terms "radial and tangential" with respect to the die bore. A spool 14 carrying metal tape for the layer 4 is mounted between flanges 14*a* on the die 1 and rotates as one with it. The metal tape is an alloy, mu-metal, of high magnetic permeability whose width is suited to the diameter of the cable to which it is applied. The tape, which has already been annealed in a conventional manner, is in fact capable of stretching without fracture for general handling purposes but this property is hardly availed of. A bight 8 of the tape is led off the drum and guided by guide bar 15 into a plane substantially parallel, or coincident with, the plane containing the tangential face 13*a* of the slot 13. The tape is lead into the slot 13 and threaded around the uncompleted cable which lies in the bore of the die. Some degree of tension must of course be applied to the tape but this is no more than is necessary to ensure a continuous, smooth, feed of tape and it is insufficient to depress the leading edge 1 of the previous turn. This tension is adjustable by a tensioning device comprising a spring 16 located between one flange 14*a* and a nut 17 whose axial position relative to the flange 14*a* is adjustable by being in screwed engagement with a screw threaded part of the die body.

The guide bar 15 is carried by an arm 18 extending radially from the spool. The angular position of the guide bar 15 relative to the die axis is rotatably adjustable by a thumb screw connection 19.

In operation the die is fixed in a chuck of a suitable rotary head and the cable to be screened is fed through the bore of the die from behind the chuck to emerge through the open ended forward portion 12. The tape for the layer 4 is led off the spool 14 over the guide bar 15 and into the slot 13 in the die. The tape enters the slot close to its leading, tangential, face 13*a* as shown in FIG. 5. The tape is given a first turn around the cable frictionally engaging the wire braid 3, and as the rotation of the die is commenced so the cable is drawn without rotation, through the die, at a constant rate. As the tape 4 leaves the leading face (or close adjacency to the leading face) of the slot 13 and enters the bore of the die proper, it is in contact with the other edge 20 of the slot, defined where the die bore wall intersects the trailing face 13*b* of the slot. The edge 20 thus applies a radially inwards pressure on the tape with the result that the marginal overlapping portion of the tape depresses the margin of the underlying lap of tape radially inwards towards the braided wire screen but leaving a small annular clearance. Partially overlapping helical turns are thus to be produced as shown in FIG. 3 without undue cold working of the tape material so preserving its magnetic properties. The pitch of the helical layer of the tape is adjusted by adjusting the rate at which the cable is pulled through the die such that the overlap of about 25% is preferably aimed at.

Because of the die shape and because the die and tape supply rotate as one, the only pressure applied to each turn of tape is a radially inwards pressure applied by the die via the overlapping portion of the next successive turn with the result that the upper lap 21 of each turn compresses the underlap 22 (see FIG. 3) as it is applied. At the same time the diameter of the emerging cable is no smaller than the bore diameter of the die portion 12, so that a correctly sized cable emerges. Moreover, the cable has a layer of tape applied with a minimum of air gaps. The tape enters the slot at an angle $\alpha$ of about 70° to the die axis.

Otherwise expressed, the method reduces deformation of the tape which degrades its magnetic properties.

As the upper lap of tape engages the lower, deformation necessary to produce a uniform diameter is shared between upper and lower layers but not equally. The lower layer being compressed radially inwards to a greater extent than the upper lap is stretched.

Construction of the cable is completed by the addition of a further braided wire screen on which the outer jacket is applied.

Both of the braided wire screens with interposed tape comprise the outer conductor. For improved screening a further magnetic tape and a braided wire screen may be applied in a similar way and in this case all three braided wire screens and both interposed magnetic tapes comprise the outer conductor.

In order to test the efficiency of the invention, a comparative test was devised to compare the transfer impedance of a cable A screened by a tape wound in accordance with the invention and a cable B screened by a tape wound by conventional contemporary equipment.

Both cables A and B were subjected to the same test designed to effect a maximum degradation of the shielding in terms of transfer impedance. Thransfer impedance is a characteristic of all shielding circuits and is defined, generally, as the voltage appearing in the shielded circuit divided by the current flowing in the shield itself. As is known to achieve adequate interference immunity a cable shield should have initially, and preserve, a low transfer impedance.

The test selected was to subject the shielded cables to cold working and progressively monitor any changes in their transfer impedances. The working resided in winding each cable onto a 50 mm diameter mandrel and off again repeatedly. Each time the direction of bending the cable was reversed.

In the accompanying FIG. 5 the number of times the cables were wound on the mandrel and off again are sealed along the abscissa, whilst the transfer impedance ($Z_T$ m $\Omega$/m) at 100 kHz are scaled along the ordinate. Both are log scales. The transfer impedance was measured. On each occasion the cable was removed and straightened for the measurement to be made. After measurement the cable was rewound but with opposite hand. The graphs show that not only did the inverted cable A have a lower transfer impedance at the outset than cable B but that the magnetic properties of the metal screen of cable B deteriorated much more rapidly than that of cable A. In fact, as a result of repeated reverse flexing the transfer impedance of cable A changed very little. As is known, low transfer impedance is a characteristic of good interference immunity.

Although the above described example relates to a co-axial cable the invention is equally applicable to triaxial or to twin cable or to cables having a multiple of conductors in the same outer protective covering. Again, although the method of forming the flexible tube selected for the example involves wrapping onto the inside surface of a tubular die through which the cable is drawn, the tube may be made separately from the internal cable components which would be inserted into the flexible tube. Thus the tape layer would be wound onto a removable mandrel which is subsequently removed and the internal cable components inserted in its stead. Alternatively again, the lengthwise flexible tube may be made by means other than tape wrapping care being taken to preserve the magnetic properties. For example, a lengthwise flexible tube may be formed by a plurality of articulated annular sections in a manner known per se, and applied over the cable inner conductor suitably insulated and shielded by a wire braid as above.

I claim:

1. A shielded electrically conducting cable comprising at least one inner electrical conductor electrically insulated from a surrounding wire braid, and a lengthwise flexible metal tube surrounding the wire braid with an annular clearance between the tube and the braid.

2. A shielded electrically conducting cable as claimed in claim 1 in which the lengthwise flexible tube is formed from helical, partially overlapping, turns of a continuous metal tape.

3. A shielded electrically conducting cable as claimed in claim 1 characterised by the addition of a further wire braid covering the lengthwise flexible tube.

4. A shielded electrically conducting cable as claimed in claim 2 in which the metal tape is made from high permeability magnetic material.

5. A shielded electrically conducting cable as claimed in claim 2 characterised in that the turns of the tape overlap one another by about 25% of the tape width.

6. A shielded electrically conducting cable as claimed in claim 4 in which the surface transfer impedance at 100Khz is less than about 100 $\mu\ \Omega$/m.

7. A shielded electrically conducting cable as claimed in claim 4 in which there is a single inner wire conductor and a shield comprising two layers of wire braid and a magnetic metal tape layer between the braid layers sensibly co-axial with the inner conductor.

8. A shielded electrically conducting co-axial cable as claimed in claim 2 in which the partially overlapping helical turns of tape are in the form of a single start helix.

9. A shielded electrically conducting coaxial cable as claimed in claim 2 in which the shield includes at least one magnetic metal screen composed of a single metal tape wound over the wire braid as a series of partially overlapping helical turns with the underlying marginal portions radially displaced towards the wire braid.

10. A shielded co-axial cable as claimed in claim 9 characterised in that said helical turns having been applied by leading a centre electrical conductor bearing a layer of insulation through a rotary tubular die, the die having a segmental slot into which the tape is fed from a spool rotating with the die to wrap around the inside face of the tubular die in a series of partially overlapping helical turns, the die diameter being such that the tape exerts substantially no binding pressure on the underlying wire braid.

* * * * *